United States Patent [19]

Vifian et al.

[11] Patent Number: 4,477,030

[45] Date of Patent: Oct. 16, 1984

[54] CONE CRUSHERS

[75] Inventors: Paul R. Vifian; Gregory C. Kint, both of Cedar Rapids, Iowa

[73] Assignee: Pettibone Corporation, Chicago, Ill.

[21] Appl. No.: 188,371

[22] Filed: Sep. 18, 1980

[51] Int. Cl.[3] ..... B02C 2/04

[52] U.S. Cl. ..... 241/208; 241/215; 308/244

[58] Field of Search ..... 241/290, 286, 207–216; 248/188.2, 308, 639; 308/244

[56] References Cited

U.S. PATENT DOCUMENTS

| | | | |
|---|---|---|---|
| 2,634,061 | 4/1953 | Rumpel . | |
| 2,713,461 | 7/1955 | Kjelgaard | 241/208 |
| 2,860,837 | 11/1958 | Werner . | |
| 3,118,623 | 1/1964 | Johnson . | |
| 3,337,143 | 8/1967 | Johnson | 241/215 |
| 3,887,143 | 6/1975 | Gilbert . | |
| 4,198,003 | 4/1980 | Polzin et al. | 241/215 X |

FOREIGN PATENT DOCUMENTS 1541159 2/1979 United Kingdom .

OTHER PUBLICATIONS

"E" Series Gyrasphere, p. 5 (Telsmith) 6–1973.
Telsmith Service Bulletin No. 59, p. 6, 3–1971.
Hydraulic Unlocking System Operating Instructions, p. 1, (Telsmith) 4–1981.
Lock Post Assembly (p. 12–3 of C–1167, Believed Nordberg) 10–1976.
Straub Mfg. Co. Bulletin 606, pp. 4 and 5, 2–1971.
Rollercone Operating Manual, p. 12 (El Jay) 5–1960.

*Primary Examiner*—Mark Rosenbaum
*Assistant Examiner*—Timothy V. Eley
*Attorney, Agent, or Firm*—Louis Robertson

[57] ABSTRACT

The gap between the bowl cone and the gyrating cone of a cone crusher, though adjustable by hydraulically lifting the bowl, is safely fixed during crushing by shims for vertical firmness and by a ring of wedge segments binding the side of the bowl. Both are held firm by spring washers, with no need to maintain a hydraulic pressure. For adjustment hydraulic jacks of one set release both shims and wedge, with the correct sequencing for removal of shims. A floater ring is normally pressed by one set of spring washers for clamping the shims. When it is pressed down hydraulically it first releases the shims, but further movement under influence of a small pump presses down the wedge segments, overcoming the spring washers which normally press the wedge segments for wedging. The shims are double shim plates some of which have slots that prevent removal of the right hand end until the left end has been swung free, and the others of which are just the opposite. Removal is dependably prevented by a pin through these shims. Oil jets at nearly the same height deliver oil to upper and lower bearings, with the upper jets jumping a gap of gyration, without need for overflooding the lower bearings, so that moderate total flow is sufficient for cooling all bearings. The pedestal spider arms, which support the inner base from the outer base while letting crushed rock fall to discharge between them, are made hollow and sealed by a bottom plate, thereby enlarging the reservoir, improving cooling, and providing fully protected tunnels from outside of the falling rock to the inner base for various selected uses.

17 Claims, 12 Drawing Figures

CONE CRUSHERS

INTRODUCTION

The invention of which this disclosure is offered for public dissemination, in the event that adequate patent protection is available, relates to gyratory crushers, also known as cone crushers. Such crushers have long been used for crushing rock. In such a crusher, a crushing cone is slightly off center below a concave surrounding bowl and is gyrated so that the point of narrowest gap between the two rotates around the center axis of the bowl. At any given point the two members act much as a simple jaw-crusher. The gap between them tapers downwardly, and relatively large rock is fed to this gap at the top. Each time the movable member approaches the fixed member, they crush rock too large to pass their reduced gap. It can then fall further down into the narrower part of the gap, and if not already fine enough to pass through it will be crushed again. In a cone crusher, this tapered gap is annular, and the rock to be crushed is fed all around the gyrating cone. As one side of the cone approaches the bowl to crush rock there, its opposite side is receding from the bowl to let the partially crushed rock drop down to the narrower part of the gap.

Although the cone crusher art is already well developed, this invention makes several improvements. Some of these improvements are in the bowl-adjustment features. Raising or lowering the bowl will adjust the gap between cone and bowl, so that the crushed rock produced will have the desired size (more accurately, range of sizes). A very slight adjustment will accomodate for wear, when the product begins to run a little too large. A larger adjustment is needed to convert the crusher from producing one size to producing another size. The adjustment problem is complex because the great crushing forces tend to require an exceedingly rigid positioning of the bowl when it has been adjusted. The present invention follows prior proved practice to the extent of locking the flange of the bowl firmly with shims, tightly pressed, and locking the body of the bowl with a split-ring wedge. One aspect of the invention is concerned with releasing the shims and the wedge to permit the adjustment, whether large or small, and to reapply this locking. According to the present invention a set of hydraulic jacks is used, its first movement releasing the shims, and further movement of the same jacks releasing the wedge. The amount of movement is determined by the amount of pumping or control of flow, and so proper sequencing is easily achieved. Except when overcome by these hydraulic jacks, two sets of Belleville spring-washers maintain the firmness of the two clamping actions for crushing, without need for hydraulics.

According to another feature of the invention, also related to bowl adjustment, improved shims are used. Where, as here, shims must be removed from the stud on which they are stacked and shifted for bowl adjustment, they are commonly slotted from one side to receive the stud, thus having a horseshoe shape. In theory, the clamping should hold them in place except when the clamping pressure is removed for adjustment. However, there is tremendous vibration, and this leads to fear that shims might shake loose unless there are safeguards to prevent this. According to the preferred form of the present invention accidental removal is positively prevented. In this form, the shims for two studs comprise two ends of one double shim plate. Although at each end a slot must be provided, the slot at one end of each plate is so disposed that the plate must be swung about this stud to remove it from the other stud before it is free to move in the direction its slot permits. At the other end, the slot is disposed differently so as not to permit any movement in the direction permitted by the first slot, preferably only the swinging movement mentioned. The preferred shape of the slot is arcuate about the stud position in the first slot. Shims in a stack are intermixed so that adjacent plates can only be removed by being first swung in opposite directions, i.e., about different studs. Although this would probably prevent them from being shaken off, complete safety is provided by slipping a pin through the stack, through holes in the respective shim plates. Without pinning them to anything else, the pins lock them together so that they can not be swung in either direction, and therefore can not be removed.

Other features of the invention relate to lubrication and cooling of the bearings. Oil must flow copiously through several sets of bearing. Supply to the highest of the bearings presents a problem, not only because gravity makes the oil prefer lower bearings, but also because of gyratory action between parts leading to it. The present invention reliably supplies the oil to that bearing by positioning an orifice where it will throw a jet stream across the varying gap resulting from gyration, with sufficient constriction of this orifice and other flow to ensure a reliable jet stream. Preferably the restriction includes another constricted orifice at nearly the same level.

The preferred system of this invention for supplying the oil to these orifices and cooling it includes improvements in the reservoir and connections to it for an external pump that is preferred. For this, a new use is made of the spider arms by which the central gyratory mechanism is supported from the outer shell or base. These spider arms are needed for letting the crushed rock drop out between the shell and central structure, to discharge.

In a common construction heretofore, the oil supply line has extended through the drive-shaft housing, with the possibility of some inconveniences. According to the present invention, a choice of three other locations is provided by hollow and horizontal spider arms at 90° and 180° locations from the drive-shaft housing. These spider arms are preferably of inverted U-shape in cross-section, and are sealed at their open bottoms by a bottom plate. These tunnel shaped arms may be varyingly used. The one most conveniently located with respect to a preferred location of an external pump for oil may be used for the connections to this pump, and for housing the return line for carrying oil to the central zone. Another may be equipped with an immersion heater, if cold weather is expected where the crusher is to be installed. A third may be equipped with a filler tube and dip stick, or, preferably, a sight gauge. All combine, together with the intervening central space, to serve as an oil reservoir. Not only is there room for a greater supply of oil, but also their large combined surface area exposed to the atmosphere yields improved cooling, sometimes avoiding the need for an external oil cooler. The inverted U-shape is a very strong construction which could permit some reduction of metal usage elsewhere.

These and perhaps other advantages of the invention may be more apparent from the drawings and from the following description.

DESIGNATION OF FIGURES

Figure 4:
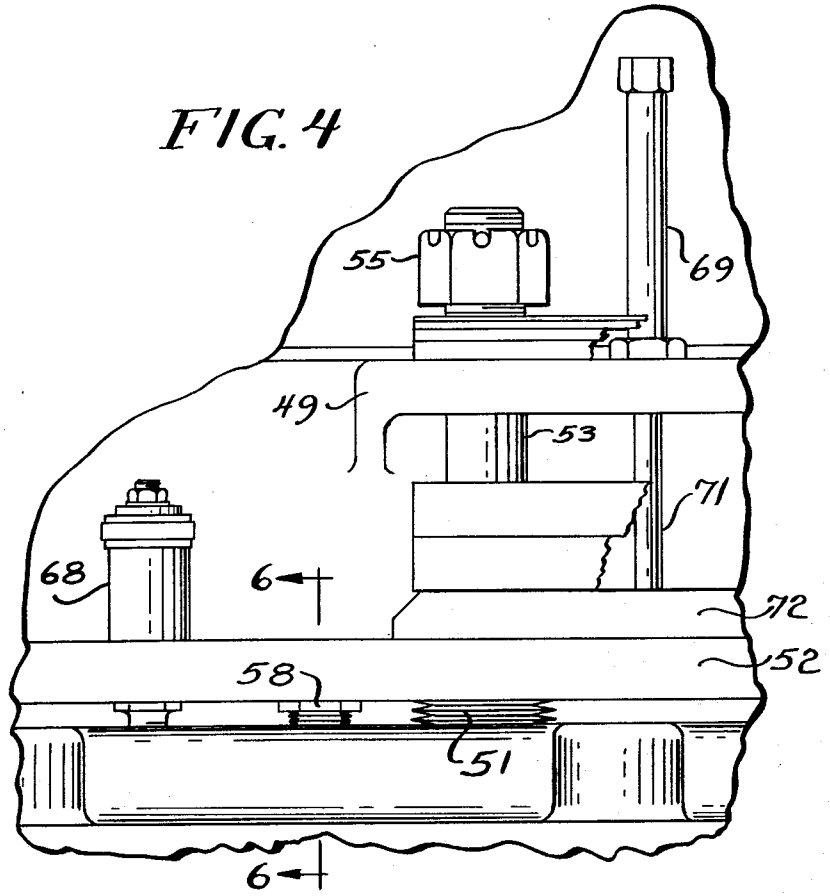
FIGS. 3 and 4 show successive bowl adjustment stages, otherwise somewhat corresponding to the left portion of FIG. 2.
Figure 5:
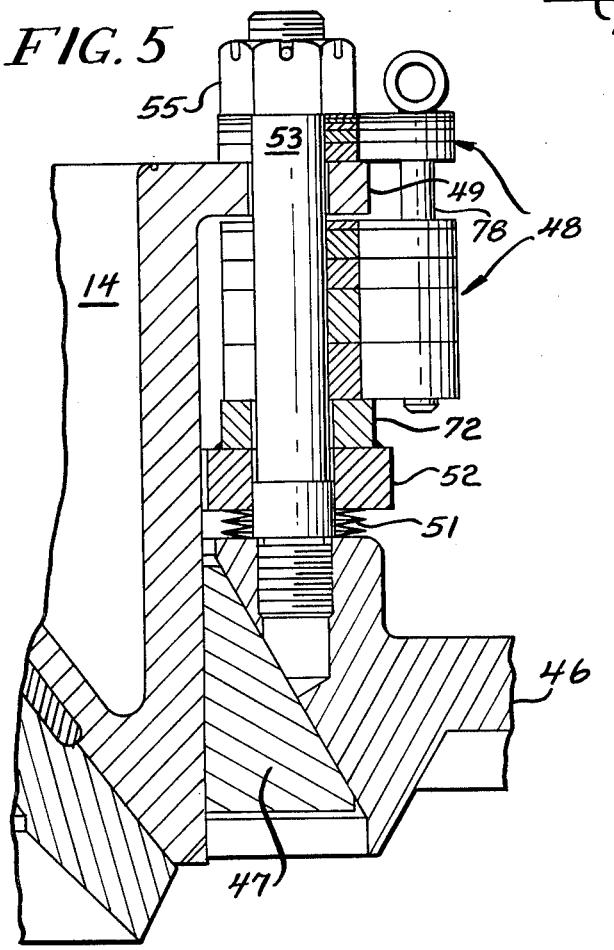
Figure 6:
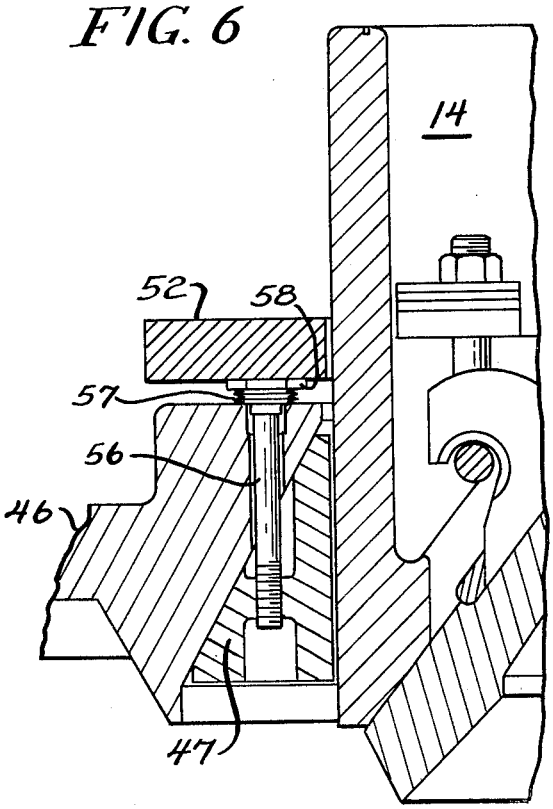

FIGS. 5 and 6 show the same successive stages, respectively, being fragmentary sectional views (lines 5—5 of FIG. 3 and 6—6 of FIG. 4) to show respectively a shim stud and a wedge control rod.

Figure 7:
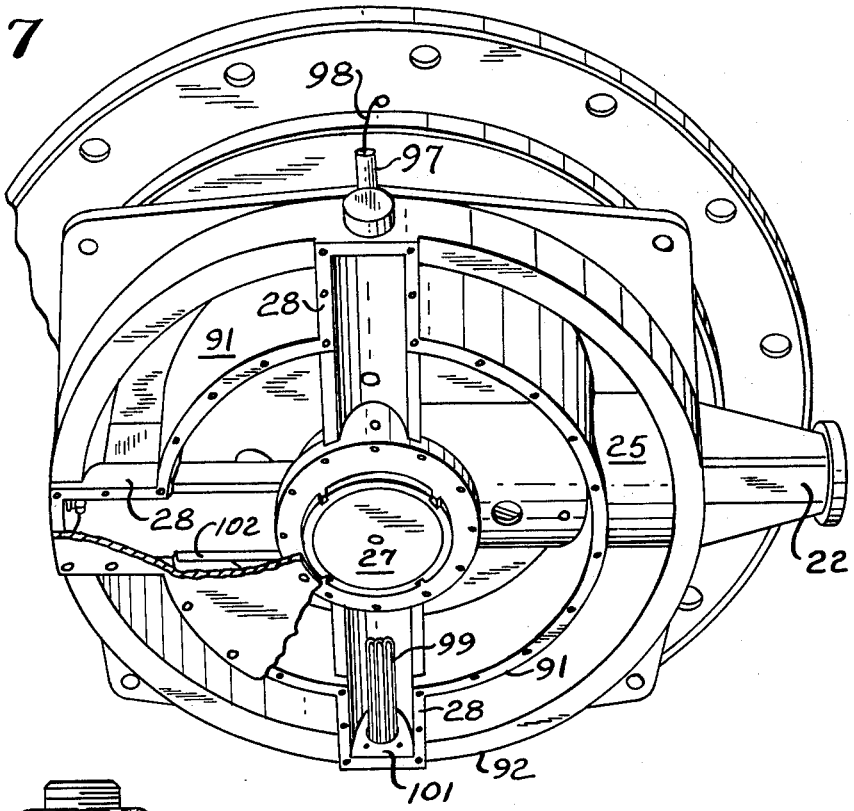

FIG. 7 shows mainly the bottom face of the pedestal or base, with a fragment of the bottom seal plate, and some fittings.

FIGS. 8 to 11 show successive steps of applying shim plates, and

Figure 12:
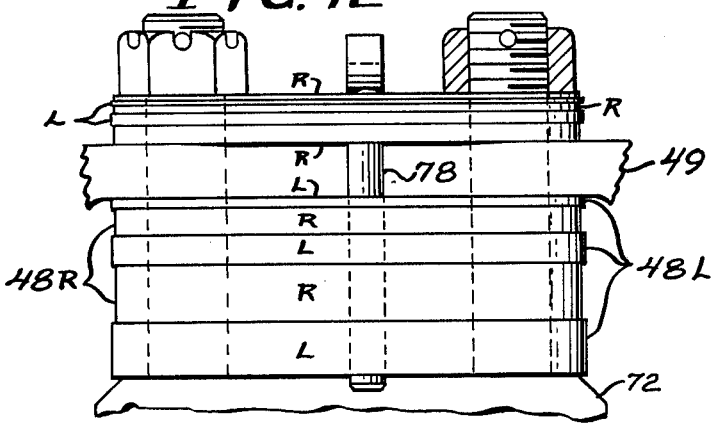

FIG. 12 shows a side face of the stacked shim plates, fragmentarily.

BACKGROUND DESCRIPTION

Although the following description offered for public dissemination is detailed to ensure adequacy of understanding, this is not intended to prejudice that purpose of a patent which is to cover each new inventive concept therein, no matter how others may later disguise it by variations in form or additions or further improvements. The claims at the end hereof are intended to aid in this purpose, as it is these that point out the various inventive concepts.

In many respects the illustrated cone crusher is similar to prior cone crushers. At the top is a feed hopper 11 into which rock to be crushed is dumped or fed. From this hopper the rock settles down between the two crushing tools, of which one is an inverted concave cone 12, more accurately called a concave, carried by an adjustable bowl 14, and the other is the gyrating cone carried by the gyrating head 16.

The crushing power is delivered by a drive shaft 17, driven by means not shown but to be applied to its outer end. A bevel gear or pinion is keyed to the inner end of drive shaft 17, and drives bevel gear 19 on the bottom of wedge rotor 21 which actuates head 16.

Drive shaft 17 is carried by a bearing housing 22, also known as a countershaft box, mounted on the main casting or pedestal 23, and extending into a tubular arm 25 therof. Pedestal 23 may also be called the bottom shell, and it is bolted to support structure or foundation 24. It carries all of the other parts of the crusher. A portion of this casting forms the inner hub 26 which carries the sturdy fixed spindle 27, on which the wedge rotor 21 rotates when driven through bevel gears 18 and 19. Casting 23 also includes very sturdy support for the inner tube 26, conventionally the tubular arm 25 and spider arms spaced to let the crushed rock fall between them to discharge. Spider arms 28 correspond to conventional spider arms, but have novel features described below.

The downward thrust of wedge rotor 21 during crushing is withstood by lower thrust bearing assembly 31, which rests on ring 32 of the casting 23, which may be called the outer hub. Wedge rotor 21, which is sometimes called an eccentric, also exerts radial force, and this is withstood by lower radial bearing assembly 33. Although this assembly is shown as including two bearing rings, one above the other, a single full height ring may be used. The bearing assembly 33 is carried by the spindle 27.

So that gyratory head 16 can gyrate with substantially no rotation, it is mounted in the eccentric upper portion of wedge rotor 21 by upper thrust bearing assembly 34 and upper radial bearing assembly 36. The axis of the upper half of wedge rotor 21 intersects the axis of the lower half and of spindle 27 at a slight angle which produces the gyration of head 16 and its cone 13.

Conventional protection from damage if tramp iron or other uncrushable material is fed to the crusher is in letting the crushing cones separate. Normally they are accurately positioned by a firm "V" fit between machined surfaces of seat ring 41 and bowl support ring 46. Except when yielding to exceptional forces due to tramp iron, support ring 46 is held firmly on seat 41 by preloaded springs 42, which press downwardly on ring 43, connected to support ring 46 by bolts 44.

Although the entire upper assembly may be deemed the bowl, the bowl in a more narrow sense is the ring to which number 14 is applied. It is carried by upper frame ring (or bowl support ring) 46 to which it is doubly locked. Radially, it is locked by wedge ring 47, spring urged upwardly in this invention. Vertically, bowl piece 14 is locked to support ring 46 by shims 48. According to the gap length desired between the crushing tools 12 and 13, the shims 48 will be shifted between their positions above and below the bowl flange 49, which they firmly clamp to a stop 55 on shim stud 53.

BOWL ADJUSTMENT FEATURES OF THIS INVENTION

Figure 1:
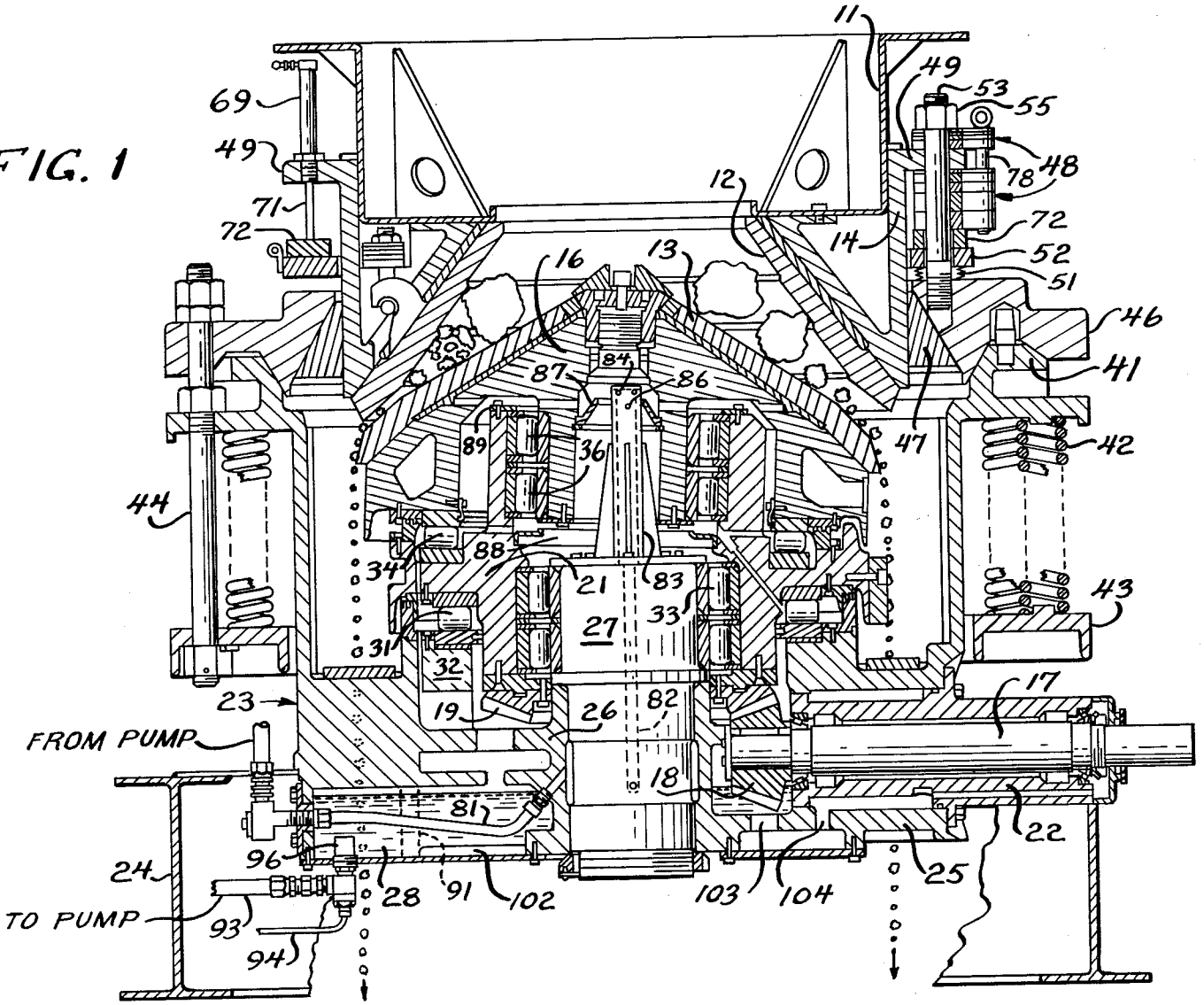
FIG. 1 is a vertical cross-section of a cone crusher in the form chosen for illustration of the invention.
Figure 2:
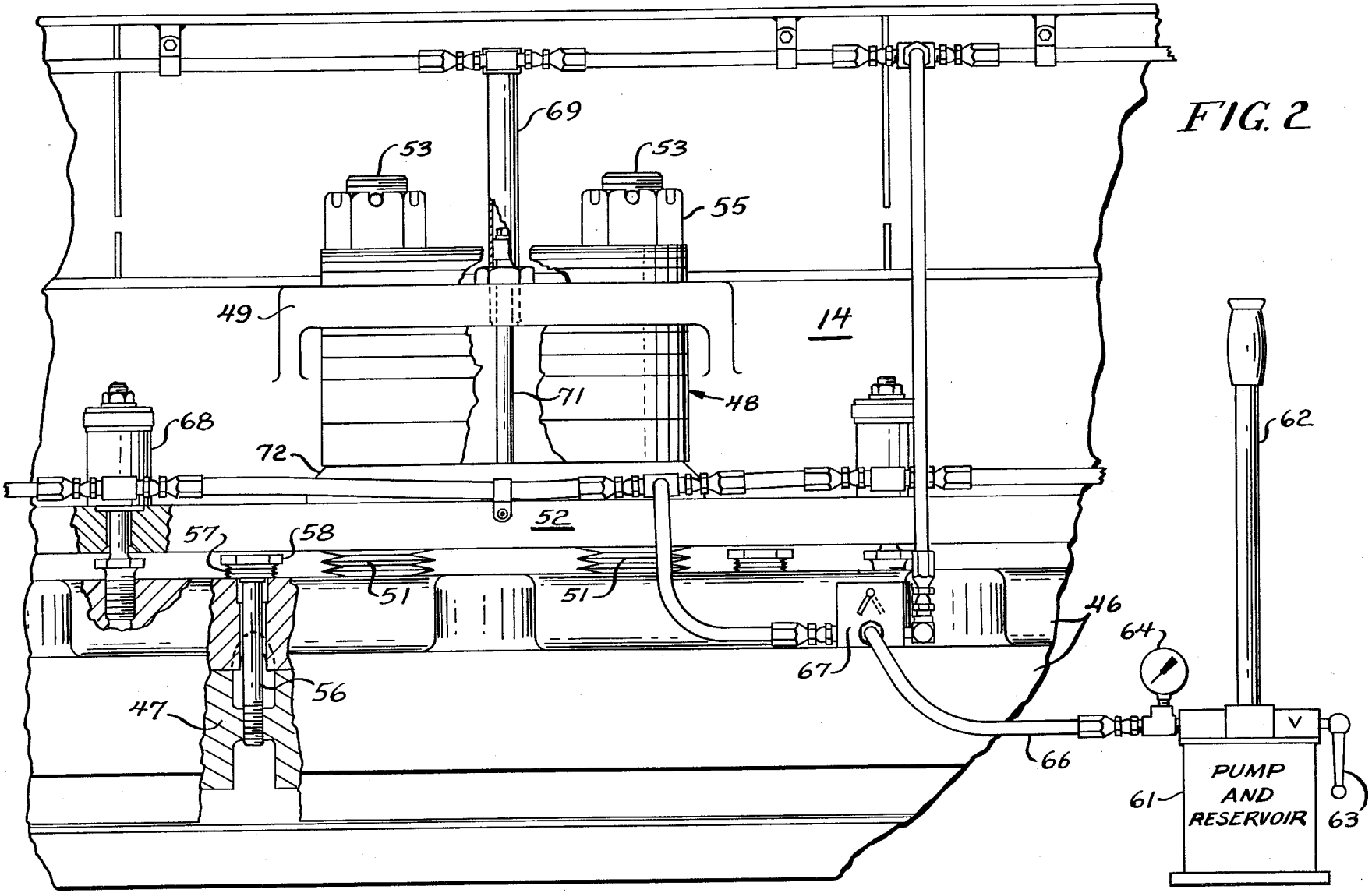
FIG. 2 is a fragmentary side view of this cone crusher, shown as if unrolled, and showing especially bowl adjustment details, other details being omitted.

As seen in FIG. 1 the shims 48 are firmly clamped against flange 49 according to the present invention by sets of Belleville spring washers 51 which press firmly upward on a floater ring 52, the upper end of the stack of shims bearing on the stop 55 on stud 53. As best seen in FIG. 2, spring action normally holds wedge ring 47 in its wedging position seen in FIG. 1. As seen in FIG. 2, wedge control rod 56, threaded to wedge 47, is urged upwardly by Belleville spring washers 57 compressed between head 58 and bowl support ring 46. Floating ring 52 is normally spaced slightly above head 58 so as not to restrict the lifting thereof by the spring washers 57. Studs 53, arranged in a circle are carried by ring 46.

From the foregoing paragraph, it is seen that during crushing, both of the clamp means are held firm by spring biasing, without any need for hydraulic pressure.

A hydraulic system, as seen best in FIG. 2, is provided for use during adjustment of the bowl, i.e. for adjustment of the gap length between the crushing tools. A hand pump 61 is provided, having a hand pumping lever or handle 62, a valve control handle 63, and preferably a gauge 64. An oil reservoir is also provided, and may be in the base of pump 61. A pressure conduit 66 leads from pump 61 to selector valve 67 which may be manually shifted to connect line 66 to either the release jacks 68 or the bowl-lifting jacks 69, closing off the line to the set of jacks not connected.

Figure 3:
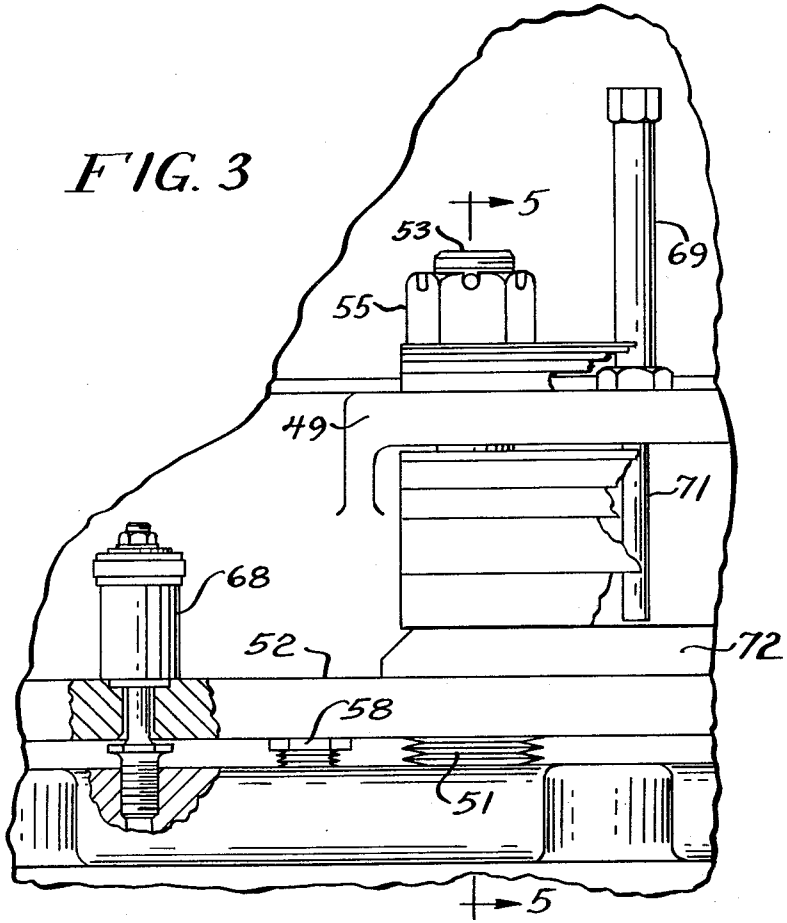

For the first step of bowl adjustment, the pump is connected to the release jacks 68, and the pump handle operated until the jacks 68 have released the shims by lowering the floating ring 52 slightly as seen in FIG. 3. At this stage, some shims can easily be removed from below bowl flange 49, if the bowl is to be lowered.

For the next stage of the adjusting operation, the pump handle is operated again to lower the floating ring 52 still more until it presses the heads 58 downwardly to the position shown in FIG. 6, wherein the wedge 47 is shown having been dislodged downwardly, resulting in its expansion, or its segments hanging loose, to release the bowl-proper 14. This will let the bowl-proper drop until the plungers 71 of bowl lifting jacks 69 (distributed around the periphery) come to rest on platforms 72, on the floating ring 52. This slight dropping of the bowl-proper 14 releases the shims above bowl flange 49, so that some of them may be removed if the bowl is to be raised.

The next step is to raise or lower the bowl. For this, the selector valve 67 is shifted to close the line from jacks 68 and open the line to jacks 69. If the bowl is to be lowered, valve handle 63 may be operated to allow a controlled flow of hydraulic fluid into the reservoir, thus lowering the bowl by gravity. If the bowl is to be raised, the pump handle 62 is operated to pump fluid to the jacks 69 until the bowl is raised to the desired level. In either event, the shims will be correspondingly arranged above and below bowl flange 49 so that the shims above and below flange 49 will be snugly ready for clamping, and will yield the desired bowl height when the clamping is complete.

Normal crusher operating conditions will be restored by the final stage of adjustment. For this the valve 63 is turned to permit fluid to flow from line 66 to the reservoir, and selector valve 67 is operated to release fluid from both sets of jacks, release jacks 68 and lift jacks 69 all around the bowl. This allows all of the spring washers to expand. Washers 51 raise the floater ring 52 to clamp the shim stack (including flange 49) against the stops on shim studs 53, and to be spaced above head 58. This allows spring washers 57 to raise heads 58, and through rods 56 raise wedge ring 47 into wedging position locking bowl piece 14 to bowl support ring 46 on which the spring washers rest.

SHIMS INTERLOCKED AGAINST VIBRATIONAL REMOVAL

Although the shims 48 could be the old style of horseshoe shaped shims (the slots permitting them to be applied to the shim studs) the improved forms shown in FIGS. 8 to 12 are preferred.

Instead of a separate set of shims for each shim stud 53, double-shim plates 48 are provided, having a shim portion at each end. These shim plates preferably are of two types according to this aspect of the invention.

Figure 8:
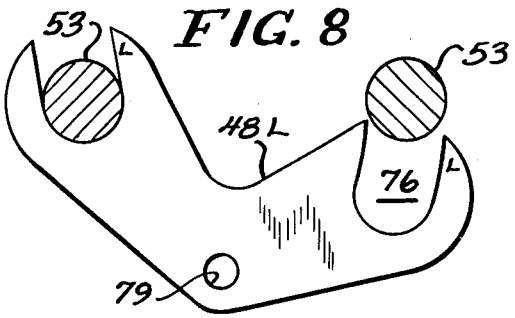
Figure 9:
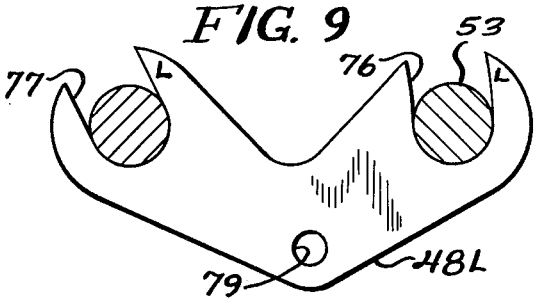

FIGS. 8 and 9 show an "L" type. The "L" may be stamped on them, but is shown mainly for clarity. It indicates "Leftward Removal". Thus, as seen in FIG. 9, the first step of removal must be to swing the shim plate 48L to the left, about the left stud 53 as an axis. Once its arcuate slot 76 has cleared the stud from which it is being removed, the shim may be shifted in the direction permitted by its other slot 77 to remove it completely. Installation is the opposite. After the shim 48L is applied at its first or left end by movement in the direction its slot permits, it is swung about that end as permitted by its arcuate slot to apply its other end to the other stud 53.

Figure 10:
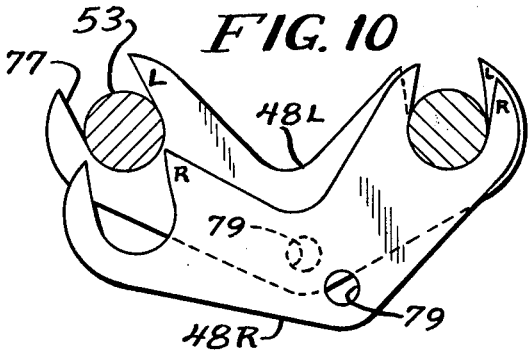
Figure 11:
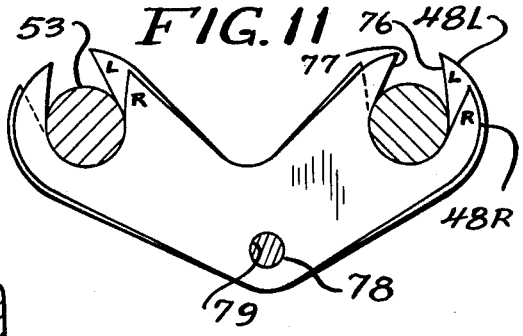

FIG. 10 shows an "R" shim plate being applied after the "L" shim plate is already in position. This plate is treated oppositely as compared to the treatment of an "L" plate. Its right end must be applied first, as shown, by movement in the direction its slot permits. Then this shim plate 48R is swung to the left about its right end to apply its left end to the other stud as permitted by its arcuate slot. FIG. 11 shows the resulting assembly with both shim plates fully applied, and the "R" type on top of the "L" type.

FIG. 11 also shows a shim keeper pin 78 inserted through the stack, as seen better in FIG. 12, through holes 79 in the various shim plates. As long as this keeper pin is in place, none of the shim plates can be removed, and therefore there is no possibility that any will fall out by vibration. The "L" plates can only be removed by a leftward swing, but this is prevented by the "R" plates which can only be removed by a rightward swing. Even without the pin 79, a stack cannot be vibrated out as if one block, and the need for relating shifting between respective plates is likely to prevent any vibration-induced fallout.

Although the "L" and "R" shim plates have been shown with slightly different dimensions, this is only for clarity of the explanation and ease of reading the drawings. In practice, they may be identical, in which case an "L" plate becomes an "R" plate merely by being turned upside down. This would permit improper stacking. As a safeguard, therefore, the holes 79 have been shown slightly off-center so that they will not be aligned for receiving the keeper pin 78 if any shim plate 48 is inverted.

JET-DISTRIBUTED OIL SUPPLY

There are some difficulties in achieving proper distribution of lubricating and cooling oil to the bearings for the head 16. These are overcome in the manner seen in FIG. 1. Oil is supplied from an external pump through line 81 and passage 82 which extends vertically through spindle 27 and its extension 83. At the top of extension 83 jets flow out from upper orifices 84 and lower orifices 86. These orifices are slightly constricted to create enough back pressure to ensure substantial uniformity of the jets, inasmuch as they are nearly at the same height. The upper jets shoot out over the upper edge of a flow dividing cone 87, even though the relative gyration leaves a substantial gap to be crossed. The lower jets hit the under side of the same cone, with easy downward flow to the lower bearings. The upper edge of cone 87 is higher than the upper bearings to ensure flow to them. There will usually be an excess of oil to overflow the bearing retainer ring 89 which forms a pool above the bearings 36. Both the overflow and the oil flowing through the upper bearing assembly 36 join the flow from lower orifices 86 to supply all bearings lower than bearings 36. A collector ring 88 forms a pool outside of it leading to the thrust bearings. Its overflow, with oil from jets 86, flows to lower radial bearings 33. From the thrust bearings 31, 34 oil flows to the bevel gears and to drive shaft 17 or its bearings, draining then to the reservoir.

HOLLOW SPIDER ARMS FOR OIL

As in previous cone crushers, an oil reservoir is provided below the the inner hub 26 and outer hub 32, which may jointly be deemed the inner base. This reservoir is defined in part by an inner skirt 91 extending down from periphery of the inner base 26,32. The inner skirt 91 is separated from an outer shell 92 to provide a passage for the falling crushed rock from the crushing tools 12 and 13. This is an annular passage, except where it is interrupted by drive-shaft housing 25 and spiders 28 which support the inner base and its hubs 26 and 32.

Heretofore, the spiders have usually sloped upwardly from the bottom of inner skirt 91 (or similar inner-base peripheries of the past) and have served only to support the inner base. According to the present invention they extend horizontally and are made tunnel shaped, so that they can serve various uses. Two of the possible uses are shown in FIG. 1, at the left. Here it is seen that the oil supply pipe 81 extends through the illustrated tunnel within one spider 28. Any of three spiders can be chosen for this purpose, depending on the most convenient location for the external oil pump. With any choice, the oil supply line 81 is fully protected from falling rock. In past crushers, the only fully protected entry was through the drive shaft housing 22. Another use illustrated in FIG. 1 is for the oil outflow connection to the external pump, through line 93. Near the outer end of a spider 28 is an especially desirable place for this outflow, because it is remote from the area into which the oil from the bearings spills. Any entrapped air from the spill will have had a chance to escape before reaching this remote outflow. There may also be provided a temperature sensing line 94, or other means for detecting a deficiency of the oil supply, and it too functions best when remote from the spill. Although the spill has been shown as falling into the same illustrated tunnel in FIG. 1, for the purpose of illustration, it could flow only into the other two tunnels 28 to provide even greater remoteness of the discharge fitting 96. The tunnels intercommunicate through openings 102.

The tunnels provided by other spider arms 28 may serve other purposes, some also benefiting by being fully protected from the falling rock, even if it should, on occasion, pile up from underneath. One use is for a filler tube 97. It may have a dip-stick, although a sight gauge is preferred if there is no automatic alarm. Another use for a tunnel in a spider arm 28 is for an immersion heater 99, which can be inserted through, mounted on and sealed to the end wall 101 of the tunnel, outside of the falling rock.

The intercommunication of the tunnels is through openings 102 from each into the reservoir space between them. Oil drain openings 103 and 104 from the drive-shaft housing 22 also lead to this reservoir space.

ADDITIONAL DISCLOSURE

Although the wedge ring 47 could be a split ring tending to expand away from bowl 14, its preferred form is a ring of numerous arcuate segments which merely hang loose when freed from their wedging condition.

Although the base 23 has been shown as one casting, the upper part above the level of the top of hub 21, may be a separate casting welded to the lower part.

A power driven pump can be used instead of manual pump 61. For preciseness of control of the jacks, it is best that a power driven pump be kept running during the bowl adjustment operation, with its discharge being by-passed to the reservoir. Then precise starting and stopping of the flow of hydraulic fluid to which ever jacks are connected through selector valve 67 can be achieved by valve operation. It is best that a separate valve, or separate valve position control bleeding from the jacks that are connected through selector valve 67 so that the operator can conduct controlled bleeding while the powered pump is discharging to the reservoir.

Release jacks 68, as now used, are spring-returned (Enerpac model RCH-121-2, for example) although simpler forms may be as good.

As is apparent from the drawings, the term "cone" is used in a more general sense than meaning a true geometric cone.

ACHIEVEMENT

From the foregoing, it is seen that a much improved cone crusher is provided. Its bowl is firmly locked by both shims and wedges, with no need for hydraulic pressure during operation. Adjustments are nevertheless easily made by successive steps using a manual hydraulic pump, with direct lifting of the bowl instead of the slow peripheral turning on threads sometimes used. The shims cannot possibly fall out due to vibration. Lubricating and cooling oil is reliably flown through all of the bearings with only moderate total flow. The oil supply features are protected and made more convenient than heretofore by selective use of newly provided tunnels in the spider arms. These tunnels also enlarge the reservoir, and improve its cooling.

We claim:

1. In a gyratory crusher having as crushing tools an annular concave through which material to be crushed is fed and a cone facing it and supported by a base, and having means for causing relative gyratory movement between the tools; the concave being carried by a bowl which is supported by a support ring carrying the bowl with vertical adjustability for varying product size, the improvement in which:

the bowl is rigidly locked to the support ring by both a stack of shims maintained under pressure by spring means, with the support ring limiting the relative spring-biased movement of the bowl, and wedge-clamping means maintained in wedging condition by spring means acting separately thereon, the spring means maintaining both of their spring biasings during operation of the crusher independently of hydraulics, and hydraulic expansion means is provided for overcoming both spring biasings to release both the shims and the wedge-clamping means.

2. The improvement according to claim 1, in which the hydraulic expansion means includes a single unit which releases both the shims at least in part, and the wedge-clamping means.

3. The improvement according to claim 1, in which the hydraulic expansion means includes a single unit which in its initial movement releases the shims at least in part, and in a further movement dislodges the wedge-clamping means.

4. In a gyratory crusher in which a base carries crushing tools and gyratory means, the gyratory means being supported by an inner base structure supported from an outer base structure in part by spaced spider arms leaving a generally annular passage between the inner and outer bases through which crushed rock falls to discharge, the improvement in which the spider arms are hollow and communicate with the central space between them to form an enlarged reservoir, with said spider arms being exposed to atmosphere for cooling.

5. In a gyratory crusher according to claim 4, the improvement further characterized in that the spider arms are formed with downward openings sealed by a bottom plate, thereby giving protected accessibility to the central space from a variety of points outside of the zone of falling rock, with access to the hollow arms, before said plate is applied, for installation of selected fittings and accessories.

6. The improvement according to claim 4 or claim 5 in which an external oil pump is connected to the reservoir through one of the hollow spider arms, with entry outside of the falling rock.

7. A shim system resistant to vibrations including two studs along which shims are to be stacked movably for clamping, toward a stop, a member which may be separated therefrom by shims, said shims being removable for varying the spacing of separation, characterized in that the shims are double shim plates having a shim at each end slotted for receiving one of the studs, the slot at one end being disposed to prevent removal of the shim plate from its stud until the shim plate has been swung about that stud to remove the other end of the shim plate from its stud.

8. A shim system according to claim 7 in which a stack of shims on said studs in an intermixture of such shim plates, at least one of which must be removed first from one stud and at least one of which must be removed first from the other stud.

9. A shim system according to claim 8 including a retainer pin extending through the stack of shims and preventing its removal by tying together said two shim plates so that the stack can not be swung in either direction.

10. In a gyratory crusher having as crushing tools an upper annular concave through which material to be crushed is fed and a cone facing it and supported by a base, and having means for causing relative gyratory movement between the tools; the concave being carried by a bowl which is supported by a support ring carrying the bowl with vertical adjustability, the improvement in which:

the bowl is rigidly locked to the support ring by both a stack of shims maintained under pressure by spring means, and wedge means maintained in wedging condition by spring means, both spring means maintaining their spring biasing during operation of the crusher independently of hydraulics, and hydraulic expansion means is provided for overpowering both spring means to release both the shims and the wedge means;

the spring means for the shims acting upon a floater member which clamps the stack of shims, and the hydraulic expansion means acting in the opposite direction on the floater member to overcome its spring means and release the shim stack.

11. In a gyratory crusher having as crushing tools an upper annular concave through which material to be crushed is fed and a cone facing it and supported by a base, and having means for causing relative gyratory movement between the tools; the concave being carried by a bowl which is supported by a support ring carrying the bowl with vertical adjustability, the improvement in which:

the bowl is rigidly locked to the support ring by both a stack of shims maintained under pressure by spring means, and wedge means maintained in wedging condition by spring means, both spring means maintaining their spring biasing during operation of the crusher independently of hydraulics, and hydraulic expansion means is provided for overpowering both spring means to release both the shims and the wedge means;

the spring means for the shims acting upon a floater member, and the hydraulic expansion means acting in the opposite direction on the floater member to overcome its spring means and release the shim stack, said floater member being coupled to the wedge means to dislodge the wedge means by movement in said opposite direction.

12. In a gyratory crusher having as crushing tools an upper annular concave through which material to be crushed is fed and a cone facing it and supported by a base, and having means for causing relative gyratory movement between the tools; the concave being carried by a bowl which is supported by a support ring carrying the bowl with vertical adjustability, the improvement in which:

the bowl is rigidly locked to the support ring by both a stack of shims maintained under pressure by spring means, and wedge means maintained in wedging condition by spring means, both spring means maintaining their spring biasing during operation of the crusher independently of hydraulics, hydraulic expansion means is provided for overpowering both spring means to release both the shims and the wedge means;

and a shim stud extends upwardly from the support ring, and floater member is urged upwardly along the stud by the spring means for the shims to clamp, between the floater member and a stop on the shim stud, a stack including shims and a flange rigid with the bowl; the hydraulic means pressing the floater member in the opposite direction to release the shims between the floater member and the flange while the wedge means is maintained in its wedging condition.

13. In a gyratory crusher having as crushing tools an upper annular concave through which material to be crushed is fed and a cone facing it and supported by a base, and having means for causing relative gyratory movement between the tools; the concave being carried by a bowl which is supported by a support ring carrying the bowl with vertical adjustability, the improvement in which:

the bowl is rigidly locked to the support ring by both a stack of shims maintained under pressure by spring means, and wedge means maintained in wedging condition by spring means, both spring means maintaining their spring biasing during operation of the crusher independently of hydraulics, hydraulic expansion means is provided for overpowering both spring means to release both the shims and the wedge means;

and a shim stud secured to the support ring extends upwardly to a stop, and a floater member is urged upwardly by the spring means for the shims to clamp, between the floater member and the stop, a stack including shims and a flange rigid with the bowl; the hydraulic means pressing the floater member in the opposite direction to release the shims between the floater member and the flange while the wedge means is maintained in the wedging condition, and then pressing the floater member further and thereby dislodging the wedge means, releasing the bowl so that it may drop down to free shims between the flange and the stop.

14. In a gyratory crusher having as crushing tools an upper annular concave through which material to be crushed is fed and a cone facing it and supported by a base, and having means for causing relative gyratory movement between the tools; the concave being carried by a bowl which is supported by a support ring carrying the bowl with vertical adjustability, the improvement in which:

the bowl is rigidly locked to the support ring by both a stack of shims maintained under pressure by spring means, and wedge means maintained in wedging condition by spring means, both springs means maintaining their spring biasing during operation of the crusher independently of hydraulics, hydraulic expansion means is provided for overpowering both spring means to release both the shims and the wedge means;

and a pair of shim studs secured to the support ring extend upwardly to stops thereon, and the spring means for the shims clamps them toward said stops, the shims comprising double-shim plates with a shim at each end slotted to receive one of said studs, the slot at one end being disposed to prevent removal of that end from the stud until the other end has been swung free, and the plates of a stack being intermixed, with at least one plate that is removable only at one stud first, and at least one plate that is removable only at the other stud first.

15. The improvement according to claim 14 including also a retainer pin through holes in the intermixed plates and preventing their removal by tying them into a single block.

16. Gyratory mechanism for a gyratory crusher including a base, a spindle extending upwardly from the base, a rotor rotatable on the spindle with bearings concentric with the axis of the spindle, means for driving the rotor, a head rotatively carried by the rotor by bearings having an axis different from the spindle axis to be gyrated by the rotor, said spindle having a passage extending upwardly through it for delivering oil to the bearings characterized by:

orifice structuure communicating with said passage and located within the head with at least one orifice delivering a jet stream higher than the highest of said bearings, and a lower orifice only slightly lower, and receiving structure out of contact with said orifice structure but receiving said jet stream and directing flow from it to the highest of said bearings while flow from said lower orifice is directed as a separate stream to lower bearings;

said base including an oil reservoir, and all of said bearings having drains leading to said reservoir by which copious oil can be flowed through said bearings for lubrication and cooling thereof, and a pump connected to pump from the reservoir to said passage;

the base including horizontally extending spider arms supporting the spindle from outer portions of the base, said arms being hollow and opening into said oil reservoir to form extensions thereof and being exposed to the atmosphere for cooling said oil.

17. Gyratory mechanism for a gyratory crusher including a base, a spindle extending upwardly from the base, a rotor rotatable on the spindle with bearings concentric with the axis of the spindle, means for driving the rotor, a head rotatively carried by the rotor by bearings having an axis different from the spindle axis to be gyrated by the rotor, said spindle having a passage formed therein extending upwardly through it for delivering oil to the bearings, characterized by:

orifice structure communicating with said passage and located within the head, at least one orifice delivering a jet stream higher than the highest of said bearings, and a lower orifice only slightly lower, and receiving structure out of contact with said orifice structure and more remote from the spindle axis but receiving said jet stream and directing flow from it to the highest of said bearings while flow from said lower orifice is directed as a separate stream to lower bearings;

said base including an oil reservoir and all of said bearings having drains leading to said oil reservoir by which copious oil can be flowed through said bearings for lubrication and cooling thereof; a pump connected to pump from said reservoir to said passage and pumping oil at a rate for developing back pressure at the orifices for jet reliability without causing total submergence of said receiving structure in a pool indistinguishable from the flow of oil to the lower bearings; and said base including horizontally extending spider arms supporting the spindle from the outer portions of the base, said arms being hollow and opening into said oil reservoir to form extensions thereof and being exposed to the atmosphere for cooling said oil.

* * * * *